US006637965B1

(12) United States Patent
Harder

(10) Patent No.: US 6,637,965 B1
(45) Date of Patent: Oct. 28, 2003

(54) WRITING INSTRUMENT HAVING A RESERVOIR BETWEEN A TIP AND A CAPILLARY STORAGE

(75) Inventor: Dale E. Harder, Placentia, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/887,193

(22) Filed: Jun. 22, 2001

(51) Int. Cl.[7] ..... B43K 5/00
(52) U.S. Cl. ..... 401/199; 401/198
(58) Field of Search ..... 401/196, 198, 401/199, 223, 224, 225

(56) References Cited

U.S. PATENT DOCUMENTS

| | | | |
|---|---|---|---|
| 535,588 | A | 3/1895 | Horton |
| 1,166,896 | A | 1/1916 | Garvey |
| 1,387,754 | A | 8/1921 | Bates |

(List continued on next page.)

FOREIGN PATENT DOCUMENTS

| | | |
|---|---|---|
| DE | 24 24 918 | 12/1975 |
| DE | 2754338 | 12/1977 |
| DE | 2434378 | 3/1986 |
| DE | 3824941 | 1/1990 |
| DE | 44 03 771 | 8/1995 |
| DE | 19832046.9 | 7/1998 |
| DE | 199 30 540 | 1/2001 |
| EP | 85115513.5 | 12/1985 |
| EP | 86109151.0 | 7/1986 |
| EP | 87105388.0 | 4/1987 |
| EP | 90111302.7 | 6/1990 |
| EP | 90306121.6 | 6/1990 |
| EP | 91106645.4 | 4/1991 |
| EP | 91115307.0 | 9/1991 |
| EP | 92401454.1 | 5/1992 |
| EP | 0899128 A1 | 8/1998 |
| EP | 00110952.9 | 5/2000 |
| FR | 87610 | 1/1965 |
| GB | 941439 | 11/1964 |
| GB | 2205280 A | 5/1988 |
| GB | 2241882 A | 2/1991 |
| JP | 59-12229 | 4/1984 |
| NL | 7701595 | 8/1978 |
| NL | 7907389 | 4/1981 |
| WO | PCT/US91/04622 | 6/1991 |
| WO | PCT/DE92/00361 | 4/1992 |
| WO | DE93/00989 | 11/1992 |
| WO | EP93/01796 | 7/1993 |
| WO | PCT/DE96/01530 | 8/1996 |
| WO | PCT/EP96/04223 | 9/1996 |
| WO | PCT/EP98/00663 | 2/1998 |
| WO | PCT/EP98/03856 | 6/1998 |
| WO | PCT/CH99/00433 | 9/1999 |
| WO | PCT/US00/17575 | 6/2000 |

OTHER PUBLICATIONS

German disclosure document entitled "Docht–Schreiber" dated Jul. 10, 1963.
Evaluation dated Aug. 3, 1989 by Institut Textile De France (ITF).

*Primary Examiner*—David J. Walczak
(74) *Attorney, Agent, or Firm*—Squire, Sanders & Dempsey, LLP

(57) ABSTRACT

A capillary wick running through the reservoir so that at least a portion of the capillary wick along the longitudinal axis is in direct contact with the liquid within the reservoir. This allows liquid in the reservoir to convey to a tip with minimal flow resistance. As such, a sufficient amount of liquid is provided to the tip, even when the writing instrument is used in quick strokes or for a long duration of time. In a writing position, a capillary storage is above the reservoir so that the capillary storage remains substantially dry without the head pressure affecting the capillary storage. The present invention is also directed to providing a porous divider wall between a reservoir that is below the storage, but without a capillary wick. Here, the porous divider wall is used to regulate air flow into the reservoir. Without the capillary wick, the unit costs and the manufacturing costs are substantially reduced.

39 Claims, 3 Drawing Sheets

U.S. PATENT DOCUMENTS

| | | | | | |
|---|---|---|---|---|---|
| 2,740,979 | A | | 4/1956 | Bridy | 15/134 |
| 3,113,336 | A | | 12/1963 | Langnickel | 15/563 |
| 3,397,939 | A | | 8/1968 | Berry | 401/198 |
| 3,457,014 | A | | 7/1969 | Ward | 401/41 |
| 3,479,122 | A | | 11/1969 | Funabashi | 401/199 |
| 3,501,225 | A | | 3/1970 | Martin et al. | 401/198 |
| 3,873,218 | A | | 3/1975 | Yoshida | 401/292 |
| 3,905,709 | A | | 9/1975 | Bok | 401/223 |
| 3,922,100 | A | | 11/1975 | Saito | 401/199 |
| 3,993,409 | A | | 11/1976 | Hart | 401/199 |
| 4,238,162 | A | | 12/1980 | Sherwood | 401/198 |
| 4,341,482 | A | | 7/1982 | Wollensak | 401/251 |
| 4,382,707 | A | | 5/1983 | Anderka | 401/198 |
| 4,496,258 | A | | 1/1985 | Tanaka et al. | 401/206 |
| 4,549,828 | A | | 10/1985 | Anderka et al. | 401/258 |
| 4,556,336 | A | | 12/1985 | Sano et al. | 401/199 |
| 4,588,319 | A | | 5/1986 | Niemeyer | 401/205 |
| 4,662,769 | A | | 5/1987 | Goh | 401/259 |
| 4,671,692 | A | | 6/1987 | Inaba | 401/199 |
| 4,712,937 | A | | 12/1987 | Schmidt et al. | 401/213 |
| 4,764,045 | A | | 8/1988 | Tschawow | 401/198 |
| 4,770,558 | A | | 9/1988 | Frietsch | 401/209 |
| 4,923,317 | A | | 5/1990 | Bishop et al. | 401/205 |
| 5,087,144 | A | | 2/1992 | Wada et al. | 401/199 |
| 5,102,251 | A | | 4/1992 | Kaufmann | 401/151 |
| 5,124,200 | A | | 6/1992 | Mallonee | 428/296 |
| 5,163,767 | A | | 11/1992 | Lucas | 401/202 |
| 5,172,995 | A | | 12/1992 | Felgentreu | 401/258 |
| 5,192,154 | A | | 3/1993 | Moeck | 401/198 |
| 5,211,495 | A | | 5/1993 | Jozat et al. | 401/217 |
| 5,290,116 | A | | 3/1994 | Chang | 401/199 |
| 5,352,052 | A | | 10/1994 | Kaufmann | 401/199 |
| 5,362,168 | A | | 11/1994 | Abe et al. | 401/206 |
| 5,407,448 | A | | 4/1995 | Brandt et al. | 401/176 |
| 5,420,615 | A | | 5/1995 | Witz et al. | 346/140 |
| 5,427,463 | A | | 6/1995 | Bastiansen et al. | 401/134 |
| 5,443,322 | A | | 8/1995 | Jozat et al. | 401/151 |
| 5,445,466 | A | | 8/1995 | Mukunoki | 401/199 |
| 5,480,250 | A | * | 1/1996 | Birden | 401/199 |
| 5,482,191 | A | | 1/1996 | Kaufmann | 222/577 |
| 5,556,215 | A | | 9/1996 | Hori | 401/199 |
| 5,622,857 | A | | 4/1997 | Goffe | 435/378 |
| 5,641,078 | A | | 6/1997 | Kaufmann | 211/69 |
| 5,865,553 | A | * | 2/1999 | Flye Sainte Marie et al. | 401/199 |
| 5,897,264 | A | | 4/1999 | Baudino | 401/199 |
| 5,927,885 | A | | 7/1999 | Duez et al. | 401/199 |
| 5,938,362 | A | | 8/1999 | Bastiansen | 401/209 |
| 5,965,468 | A | | 10/1999 | Marmon et al. | 442/340 |
| 5,971,646 | A | | 10/1999 | Chavatte et al. | 401/199 |
| 6,039,486 | A | | 3/2000 | Breslin | 401/88 |
| 6,062,758 | A | | 5/2000 | Maurer et al. | 401/199 |
| 6,089,776 | A | | 7/2000 | Kaufmann | 401/199 |
| 6,095,707 | A | | 8/2000 | Kaufmann | 401/199 |
| 6,183,155 | B1 | | 2/2001 | Kaufmann | 401/199 |

* cited by examiner

FIG. 7
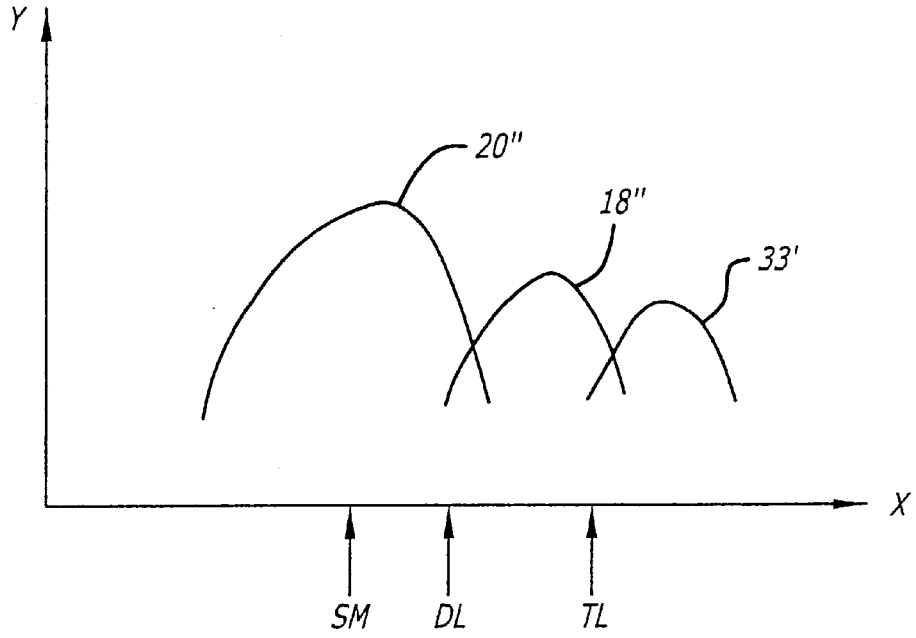
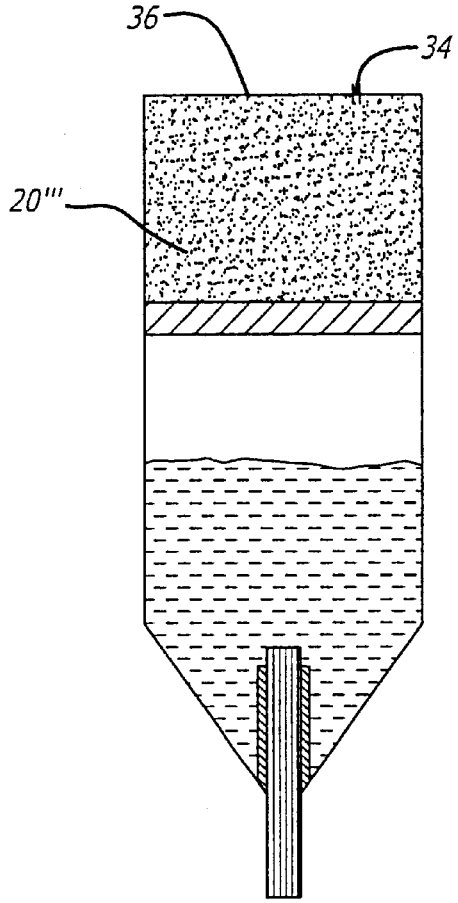
FIG. 8

WRITING INSTRUMENT HAVING A RESERVOIR BETWEEN A TIP AND A CAPILLARY STORAGE

BACKGROUND OF THE INVENTION

1. Field of the Invention

The present invention relates generally to a fluid dispensing utensil and, more particularly, to a writing instrument having a reservoir between a tip and a capillary storage.

2. General Background and State of the Art

Writing instruments are commonly used to deliver liquids such as ink, paint, adhesive, shoe polish, lotion, medicine, perfume, makeup, Whiteout® and food. In one type of fluid dispensing utensil, a relatively large volume of fluid is stored in a non-capillary container (or reservoir) where it is allowed to move freely. Pens which incorporate such a container, for example, are referred to as "free ink" pens or markers. U.S. Pat. No. 6,095,707 issued to Kaufmann discloses such a pen. That is, the ink in the reservoir is usually in a liquid state and is free to move about as the writing utensil is moved. One of the nice features of free ink markers is that they are visually appealing to users as the liquid moves around within the container. Moreover, free ink markers tend to last longer than other pens.

Liquid in these utensils is transferred from the container to the delivery end (often referred to as a tip or a nib) via a capillary conveying line or referred to as a capillary wick. A slight vacuum (underpressure) relative to the atmosphere is maintained within the container which prevents liquid in the conveying line from escaping from the utensil until the tip is brought into contact with the surface onto which liquid is to be dispensed. At this point, the force of attraction of the surface and the capillary force of the space between the surface and portions of the tip, which are not in direct contact with the surface, will cause the liquid to flow from the tip to the surface. As liquid is dispensed, air enters the container in a controlled manner via an air inlet that is formed in the container and ends within the liquid. The air replaces the liquid so as to maintain the vacuum at a relatively constant level.

To deal with the problem of leakage caused by air expansion within the container, a capillary storage is used to absorb the excess liquid. Specifically, when the air within the container is heated, it expands. Alternatively, as the writing instrument is used in a higher elevation, the underpressure within the container will rise and increase the vapor pressure on the liquid. This forces excess liquid to flow through the conveying line via capillarity action. To handle the excess liquid, some ink pens or markers include an overflow chamber having a capillary storage that will absorb the excess ink. Fountain pens, for example, include a capillary storage in the front section of the writing instrument next to the tip.

Because the capillary storage is on the front section of the writing instrument or below the reservoir in a writing position, the head pressure of the liquid in the reservoir may keep at least a portion of the capillaries in the capillary storage wet. This means that when there is a rise in temperature or pressure within the reservoir, only the unwetted or dry capillaries in the capillary storage can absorb the excess ink from the reservoir. As such, the capillary storage may need to be oversized to account for the fact that at least some portion of the capillaries will be wetted due to the head pressure in the reservoir. However, a larger capillary storage means that the circumference of the writing instrument, which is housing the capillary storage, needs to be bigger as well. This is one of the reasons why a free ink writing instrument is generally thicker than a ballpoint pen, for example, and therefore not as comfortable for the user to utilize.

Still further, the longer the capillary conveying line, the greater flow resistance it has to convey the ink from the reservoir to the tip. This means that if a user writes quickly or for a long duration of time, the conveying line may dry out and therefore not write properly.

Still further, most free ink writing instruments are assembled from several pieces including a capillary conveying line capillary storage, a divider separating the reservoir and a storage area, all enclosed in a container. All of the above pieces add cost and manufacturing time to manufacture a writing instrument. To minimize the cost of the writing instrument, there is a need to manufacture a writing instrument with fewer pieces. Moreover, there is a need to keep most if not all of the capillaries in a capillary storage dry so that most, if not all, of the capillaries in a capillary storage may absorb excess ink from the reservoir. Even further, there is a need to minimize the flow resistance in the conveying line so that a sufficient amount of ink is delivered to the tip of the writing instrument under most if not all writing conditions.

BRIEF SUMMARY OF THE INVENTION

One of the features of the present invention is to provide a writing instrument having a relatively small circumference so that it may be comfortably held in a user's hand for writing. Another feature of the present invention is to minimize the flow resistance in a conveying line so that a sufficient amount of ink or liquid may be delivered to a tip of the writing instrument. Still another feature is to provide a writing instrument that is easier to manufacture at a lower cost.

The present invention accomplishes the above features by providing a reservoir for holding liquid or ink between a capillary storage and a tip. That is, according to one embodiment of the present invention, the capillary storage is above the reservoir so that any head pressure in the reservoir or the column of liquid does not affect the capillary storage. This means that the capillary storage will remain substantially dry so that most, if not all, the capillaries in the capillary storage may absorb the excess ink in the reservoir due to a rise in temperature or pressure within the reservoir.

Still another feature of the present invention is to have a conveying line running through the reservoir so that at least a portion of the conveying line along the longitudinal access is in direct contact with the liquid within the reservoir. This means that the liquid in the reservoir may convey to the tip with minimal flow resistance. As such, a sufficient amount of liquid is provided to the tip, even when the writing instrument is used in quick strokes or for a long duration of time.

Yet another embodiment of the present invention is to provide a reservoir between the storage and the tip, but without a conveying line. That is, without the conveying line, the unit costs and the manufacturing costs are substantially reduced. In this embodiment, the reservoir is also below the capillary storage, and they are divided by a porous or a capillary divider wall. Here, the porous divider wall is used to regulate air flow into the reservoir. That is, as the temperature or pressure in the reservoir increases, air will displace the liquid in the largest pore in the porous divider wall to equalize the pressure in the reservoir. With regard to the displaced liquid from the largest pore size in the porous divider wall, such liquid may be temporarily stored in the capillary storage that is in direct contact with the porous divider wall. On the other hand, as the temperature or pressure within the reservoir drops, air will flow back into the reservoir through the largest pore size in the porous divider wall.

In situations where the tip is facing upward or in an inverted position, the porous divider wall may be fully saturated and, if there is a rise in temperature or pressure within the reservoir, the excess ink from the reservoir may be temporarily stored in the capillary storage. Likewise, as with the previous embodiment, since the capillary storage is above the reservoir in a normal writing position, a smaller capillary storage may be used because, under normal conditions, most if not all the capillaries in the capillary storage will be empty of liquid. This is principally due to the fact that the capillary storage which is above the reservoir is not affected by the head pressure due to the column of liquid in the reservoir.

The above described and many other features and attendant advantages of the present invention will become apparent from a consideration of the following detailed description when considered in conjunction with the accompanying drawings.

BRIEF DESCRIPTION OF THE DRAWINGS

FIG. 7 is an exemplary distribution of pore sizes or capillarity between a capillary storage, a porous divider wall, and a tip; and FIG. 8 is an exemplary cross-sectional view of yet another embodiment of the present invention showing a capillary storage being adjacent a hole.

DETAILED DESCRIPTION OF THE PREFERRED EMBODIMENTS

This description is not to be taken in a limiting sense, but is made merely for the purpose of illustrating the general principles of the invention. The section titles and overall organization of the present detailed description are for the purpose of convenience only and are not intended to limit the present invention By way of background, it should be noted that the descriptive term "capillarity" has been used herein to indicate the height up to which a liquid ascends within a pore of a given diameter. The greater the height, the greater the capillarity. In general, small size pores have greater capillarity than the larger size pores. In other words, the term "capillarity" is indicative of the attractive force between a liquid and a pore. Moreover, U.S. Pat. Nos. 6,089,776 and 6,183,155 B1, and U.S. patent application Ser. Nos. 09/591,114 filed Jun. 9, 2000, 09/839,380 filed Apr. 20, 2001, 09/839,842 filed Jun. 20, 2001, and 09/839,843 filed Jun. 20, 2001, are all hereby incorporated by reference into this patent application.

Figure 1:
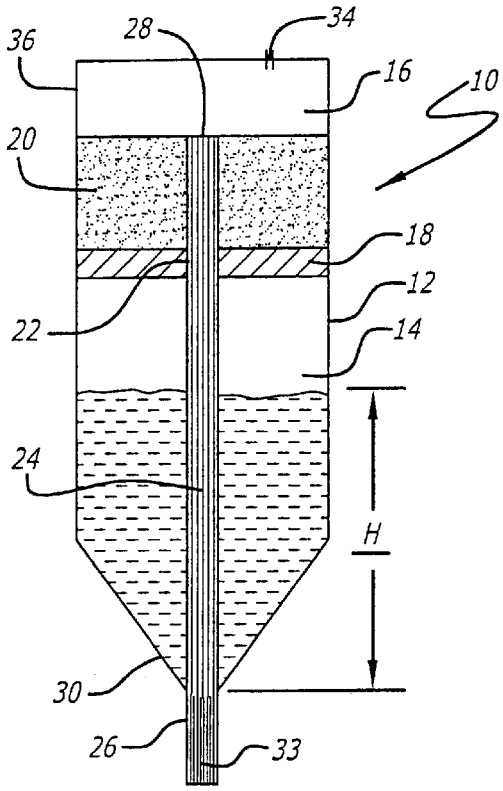
FIG. 1 is an exemplary cross-sectional view of a writing instrument showing a reservoir between a capillary storage and a tip.

FIG. 1 illustrates by example a writing instrument 10 comprising a container 12 having a divider wall 18 defining a first storage area 14 (reservoir) and a second storage area 16. The first storage area 14 is used to store liquid, and within the second storage area is a capillary storage 20. The divider wall 18 also has an opening 22 which allows a capillary wick 24 having a proximal portion 26 and a distal portion 28 to extend through the second storage area 16 and the first storage area 14. That is, the distal portion 28 penetrates through the opening 22 and into the capillary storage 20. Note that at least a portion, if not all, of the distal portion 28 of the capillary wick 24 is in direct contact with the capillary storage 20. Also, the proximal portion 26 protrudes through the writing side 30 of a container 12 and may be aligned to be in direct contact with a tip 33.

As further illustrated in FIG. 1, the distal portion 28 of the capillary wick 24 substantially fills the opening 22 in the divider wall 18. This way, the capillary storage 20 only comes into contact with the liquid in the first storage area 14 via the capillary wick 24. Moreover, a proximal portion 26 protrudes from the writing side 30 such that it is completely sealed between the capillary wick 24 and the writing side 30. A seam may be provided, for example, by crimping the capillary wick 24 and the contact area between the capillary wick and the writing side 30. Alternatively, any other methods known to one skilled in the art may be used to seal the capillary wick 24 from the writing side 30.

Figure 2:
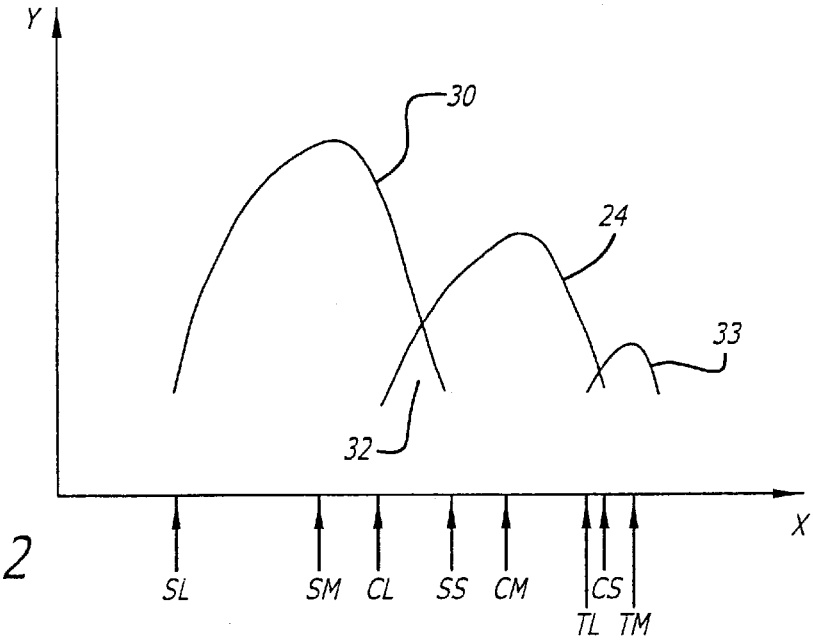
FIG. 2 is an exemplary distribution of pore sizes or capillarity between a capillary wick, a capillary storage, and a tip.

FIG. 2 illustrates by way of example a general distribution of pore sizes between the capillary wick 24 and the capillary storage 20. With regard to the graph in FIG. 2, axis "X" represents a capillarity potential of pores or smaller pore sizes from left to right, and axis "Y" generally represents percentage pores. Moreover, graphs 24 and 20 illustrate exemplary measurable distribution of pore sizes in the capillary storage and capillary wick, respectively. Reference points "SL" refer to a measurable largest pore size in the capillary storage, "SM" refers to a measurable mean flow pore in the capillary storage, and "SS" refers to a measurable smallest pore size in the capillary storage; "CL" refers to a measurable largest pore size in the capillary wick, "CM" refers to a measurable mean flow pore in the capillary wick, and "CS" refers to a measurable smallest pore size in the capillary wick. Note that with the above distribution of pore sizes, there may be an overlap 32 between the smallest pore size in the capillary storage SS and the largest pore size in the capillary wick CL. Moreover, since the liquid 30 is in direct contact with the capillary wick 24 and because the capillarity force in the capillary wick 24 is greater than the capillary storage 20, the capillary wick 24 will remain wetted. The pore size in the capillary wick and capillary storage may be measured by Porous Materials, Inc., located at 83 Brown Road, Ithaca, N.Y. 24850.

Moreover, if there is an overlap region 32 between the capillary wick 24 and the capillary storage 20, some portion of the capillary storage 20 may be wetted depending on the orientation of the writing instrument 10. For instance, if the writing instrument is in an inverted position, i.e., the tip 33 is facing up, then liquid in the first storage area 14 is held in place by an "underpressure" (slight vacuum) of the air above the ink, which counteracts the force of gravity or weight of the column of liquid in the first storage area, i.e., the head pressure. With the head pressure above the capillary storage 20 in an inverted position, some portion of the capillary storage 20 may be wet.

If the writing instrument 10 is in a writing position, i.e., the tip is facing down, so that the capillary storage 20 is above the first storage area 14, then the capillary storage 20 is not affected by the head pressure. Accordingly, most if not all of the capillaries in the capillary storage 20 may be substantially empty, i.e., dry. This improves the performance of the capillary storage because most if not all of the capillaries in the capillary storage 20 may absorb the excess liquid from the first storage area 14. This means that with the present invention, a smaller size capillary storage may be used, which means a container having a smaller circumference may be used as well. Therefore, with the present invention, a free ink writing instrument may be as small as a ballpoint pen to write more comfortably.

Moreover, with the above distribution of pore sizes between the capillary wick 24 and the capillary storage 20, as the underpressure within the first storage area subsides, i.e., increase in absolute pressure in the first storage area 14, some liquid within the first storage area will convey through the capillary wick 24 and be absorbed by the capillary storage 20, until the underpressure in the first storage balances out. That is, at least some of the excess liquid will convey through the capillary storage 20 and store temporarily in the capillary storage 20. On the other hand, once the underpressure within the first storage area rises, i.e., a decrease in absolute pressure within the first storage area, liquid in the capillary wick is drawn back into the first storage area 14. Note that the underpressure in the first storage area 14 may change for a number of reasons such as a change in the temperature or elevation at which the writing instrument is used.

With regard to head pressure or column pressure in the first storage container, the smaller the capillary pore size, the greater resistance it has to the head pressure, and conversely, the larger the capillary pore size, the less resistance it has to the head pressure. That is, if the largest pore size in the tip 33 is too big, then there is a possibility that the liquid in the first storage 14 may leak through that largest pore size. As such, the largest pore size needs to be properly sized or controlled.

In general, the head pressure within the first storage 14 may be derived by knowing the height "H" of the liquid above the proximal portion 26, and also based on the density of the liquid. Based on head pressure, the capillary resistance to pressure, in other words, the resistance in the largest pore size in the tip may be calculated. Capillary resistance to pressure, commonly referred to as "bubble point," is the pressure required to displace liquid with air in the largest pore, which may be derived from the following equation:

| | |
|---|---|
| $P = 4 * \gamma * \cos\theta$ | where:<br>p is capillary pressure<br>$\gamma$ is the surface tension of the liquid; and<br>$\theta$ is the contact angle of the liquid and solid, that is when the liquid completely wets the solid, $\cos^{\theta}$ goes to 1. |

Moreover, other methods known to one skilled in the art may be used to size the pore sizes in the tip. For example, a variety of tips having different pore sizes may be experimented with until a tip sufficiently restricts the head pressure. Referring back to FIG. 2, graph 33 illustrates the exemplary measurable distribution of pore sizes in tip 33. Reference point "TL" refers to a measurable largest pore size in the tip, and "TM" refers to a measurable mean flow pore in the tip. Accordingly, TM is smaller than CM, and TL is smaller than CL. That is, the pore sizes in the tip 33 are sized to provide sufficient resistance to head pressure in the first storage area 14 to restrict liquid from leaking through the tip. And, because TL is smaller than CL, air will enter through the distal portion of the capillary wick 28 to relieve the rise in underpressure in the first storage area rather than through the proximal portion 26 due to smaller capillaries blocking passage of air through the tip. As such, to provide air passage, a hole 34 may be provided in the rear side 36 of the container 12 to allow outside air to enter through the hole 34 and then through the largest pore size in the distal portion 28 of the capillary wick 24.

Figure 3:
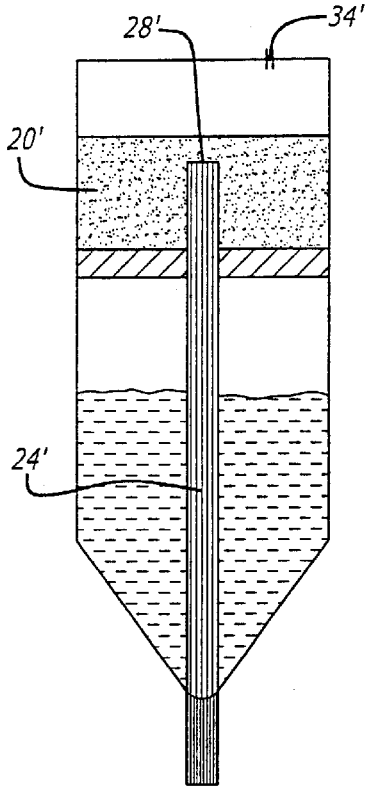
FIG. 3 is an exemplary cross-sectional view of a writing instrument in accordance with another embodiment showing a capillary conveying line partially through a capillary storage.
Figure 4:
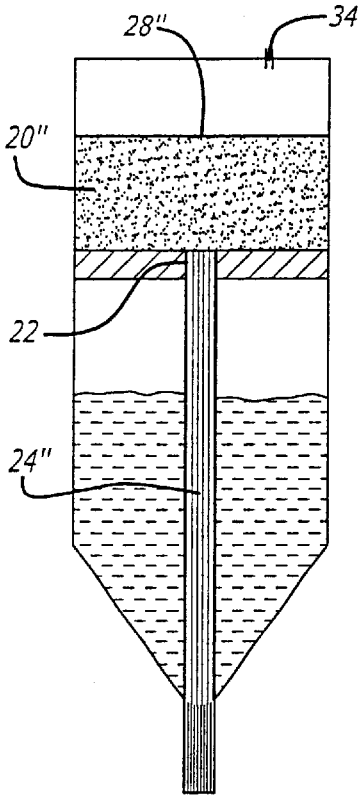
FIG. 4 is an exemplary cross-sectional view of yet another embodiment of the present invention showing a capillary conveying line adjacent a capillary storage.

FIG. 3 illustrates by way of example an alternative embodiment to the present invention having a distal portion 28' of a capillary wick 24' that runs partially through a capillary storage 20', unlike the embodiment illustrated in FIG. 1. Still further, FIG. 4 illustrates by way of example a distal portion 28" of a capillary wick 24" that runs through the opening 22 and is in direct contact with a capillary storage 20" without penetrating it. In other words, air enters through the capillary storages 20' and 20" and then to the distal portions 28' and 28", respectively, to relieve the rise in underpressure.

Figure 5:
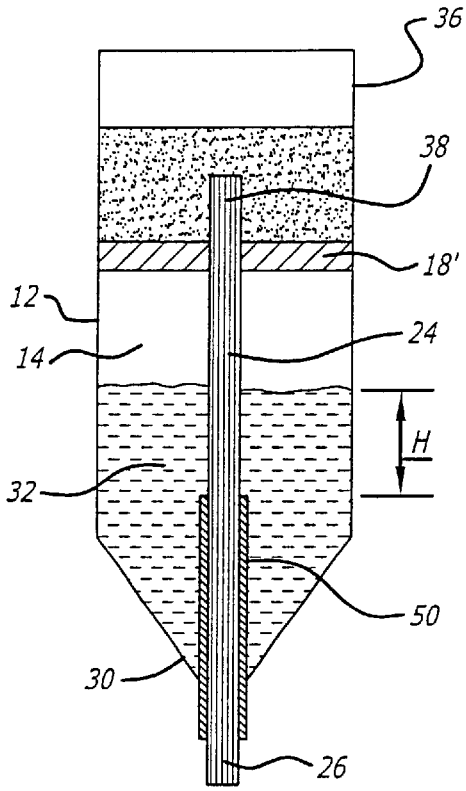
FIG. 5 is an exemplary cross-sectional view of still another embodiment of the present invention showing a tube partially sealing a capillary conveying line within a reservoir.

FIG. 5 illustrates by way of example yet another embodiment of the present invention to minimize the head pressure due to the column of liquid in the first storage area 14. To do so, a sleeve or tube 50 is provided from the writing side 30 to form a lip 52 in the first storage area 14 around the capillary wick 24. The sleeve 50 seals at least a portion of the capillary wick 24 from the liquid in the first storage area 14. The sleeve or tube 50 may be a film wrapped around the capillary wick 24. As such, the head pressure "H" within the first storage area 14 is reduced because the column of liquid now applied to the capillary wick 24 is from the lip 52 rather than from the writing side 30. With reduced head pressure, smaller capillaries in the tip may not be needed to resist the head pressure like the embodiment discussed above in FIG. 1. In other words, in this embodiment, the head pressure may be adjusted based on the length of the sleeve 50 so that the largest pore size in the capillary wick can resist the head pressure, yet allow air to enter through the largest pore size to compensate for a rise in underpressure in the first storage area 14.

Accordingly, with the embodiment illustrated in FIG. 5, a tip may not be needed to resist the head pressure and air may pass through the proximal portion 26 of the capillary wick 24. Still further, a porous divider wall 18' may be provided with the hole 34 on the rear side 36 to allow air to pass through the porous divider wall 18' to compensate for the changes in underpressure within the first storage area, rather than through the largest pore size in the capillary wick 24. In this regard, U.S. patent application Ser. No. 09/591,114 filed Jun. 9, 2000 is hereby incorporated by reference into this application.

Figure 6:
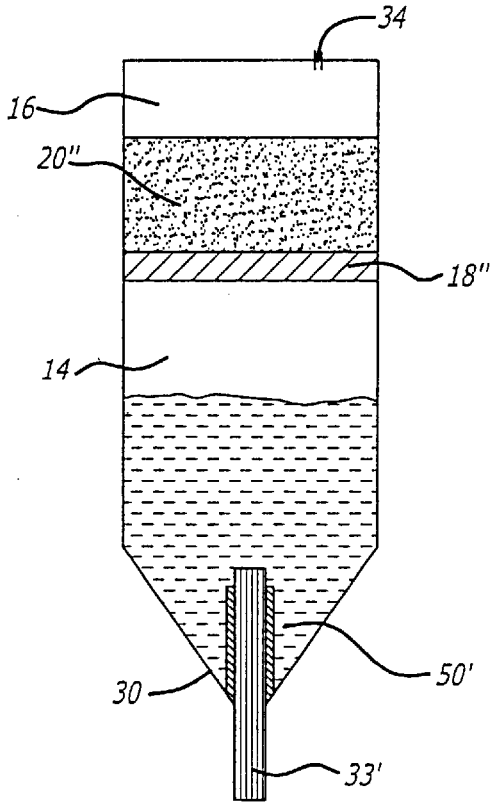
FIG. 6 is an exemplary cross-sectional view of another embodiment of the present invention showing a reservoir between a capillary storage and a nib, but without a capillary conveying line.

FIG. 6 illustrates by way of example still another embodiment of the present invention having a tip 33' (or sometimes referred to as a nib) within a sleeve 50' extending partially into the first storage area 14 without touching the porous divider wall 18". Moreover, the porous divider wall 18" does not have an opening between the first and second storage areas 14, 16 so that liquid or air in the first storage area 14 goes through the pores or the capillaries in the divider wall 18". In the second storage area 16, the capillary storage 20" is in direct contact with the divider wall 18".

FIG. 7, generally illustrates the distribution of pore sizes among the tip 33', porous divider wall 18", and capillary storage 20". As in FIG. 2, axis "X" represents a capillarity potential of pores or smaller pore sizes from left to right, and axis "Y" generally represents percentage pores. Accordingly, the measurable largest pore size in the porous divider wall "DL" is greater than the measurable largest pore size in the tip "TL" so that air will pass through the porous divider wall 18" rather than through the tip 33' to compensate for the changes in the underpressure within the first storage area 14. Moreover, DL is generally smaller than the measurable mean flow pore of the capillary storage "SM" so that the capillary storage 20" substantially remains dry relative to the porous divider wall 18". With regard to the tip 33', the sleeve 50' may be provided to minimize the head pressure within the first storage area 14, and TL is sized to sufficiently resist the head pressure to restrict the liquid from leaking through TL.

With the above embodiment and the distribution of pore sizes as illustrated in FIG. 7, as the underpressure in the first storage subsides, i.e., absolute pressure increases, air above the liquid in the first storage area will pass through the largest pore size in the porous divider wall DL and into the capillary storage 20" and out of the hole 34. Conversely, as the underpressure rises in the first storage area 14, air will pass through DL and into the first storage area 14 to compensate for the rise in underpressure. For instance, as the writing instrument is used, liquid or ink will convey through the tip 33' and onto a writing surface, such as paper, causing underpressure to develop in the first storage area 14. To relieve the underpressure in the first storage 14, air will pass through DL and into the first storage area 14. In other words, the porous divider wall 18" is used to regulate the air in and out of the first storage area 14.

When the writing instrument is in a horizontal or inverted position, the porous divider wall 18" may be fully saturated or wet. And if the underpressure subsides in the first storage area, then the capillary storage 20" which is in direct contact with the porous divider wall 18" will absorb the excess liquid from the first storage. Conversely, as the underpressure rises, liquid will convey back into the first storage area.

There are a number of advantages to the above embodiment. First, there is no need for a capillary wick, which saves cost. And, second, a smaller capillary storage may be used because the capillary storage remains substantially dry.

FIG. 8 illustrates by way of example yet another embodiment of the present invention where the capillary storage 20"' is adjacent hole 34 on the rear side 36. Such an arrangement prevents any liquid droplets that may be formed within the second storage area 16 from leaking out of the hole 34.

In closing, it is noted that specific illustrative embodiments of the invention have been disclosed hereinabove. However, it is to be understood that the invention is not limited to these specific embodiments. For instance, sleeve 50 may be molded within the first storage area along with the container 12. The porous divider wall may be a porous plastic to control the size of the pores. Moreover, the tip in FIG. 6 may extend from the writing side 30 without the sleeve within the first storage area. In such a case, the pore sizes in the tip may be smaller than a tip with a sleeve to restrict greater head pressure. With regard to FIGS. 2 and 7, the percentage of pores along the Y axis may vary among the capillary storages, capillary wick, tip, and the porous divider wall. For instance, the percentage of pores in the capillary storage may be less than the capillary pore or the porous divider wall. With regard to liquid, it may be a solvent-based ink or a water based ink or any other ink known to one skilled in the art. With regard to the nib 18', it may be manufactured by Teibow Hanbai Co. Ltd., located at 10–15 Higashi Nihonbashi 3 chome, Chou-Ku, Tokyo 103, Japan. Moreover, the pore sizes in the capillary storage, capillary wick, tip, and porous divider wall may be measured by Porous Material, Inc., 83 Brown Road, Ithaca, N.Y. 14850.

With respect to the claims, it is applicant's intention that the claims not be interpreted in accordance with the sixth paragraph of 35 U.S.C. §112 unless the term "means" is used followed by a functional statement.

What is claimed is:

1. A writing instrument, comprising:

a container having a writing side and a rear side;

a divider wall having an opening within the container between the writing and rear sides defining a first storage area for storing liquid and a second storage area;

a capillary storage within the second storage area, the capillary storage having an approximate mean storage pore size; and a capillary wick having a proximal portion and a distal portion, the proximal portion protruding from the writing side of the container and the distal portion through the opening of the divider wall and in contact with the capillary storage, the capillary wick having an approximate mean wick flow pore size, the approximate mean wick flow pore size of the capillary wick being smaller than the approximate mean storage pore size of the capillary storage, wherein the capillary storage has an approximate smallest storage pore size, and the capillary wick has an approximate largest wick pore size, wherein the approximate smallest storage pore size is at least as small as the approximate largest wick pore size.

2. A writing instrument according to claim 1, wherein the smallest storage pore size is greater than the approximate mean wick flow pore size of the capillary wick.

3. A writing instrument according to claim 1, wherein the approximate largest wick pore size in the capillary wick allows air to enter the first storage area to compensate for the liquid taken from the first storage area of the container through the capillary wick.

4. A writing instrument according to claim 3, wherein air enters through the approximate largest wick pore size in the proximal portion of the capillary wick.

5. A writing instrument according to claim 1, wherein the rear side of the container has a hole.

6. A writing instrument according to claim 5, wherein the approximate largest wick pore size in the capillary wick in the distal portion of the capillary wick allows air to enter the first storage area to compensate for the liquid taken from the first storage area of the container through the capillary wick.

7. A writing instrument according to claim 5, wherein the approximate largest wick pore size in both the proximal and distal portions of the capillary wick allow air to enter the first storage area to compensate for the liquid taken from the first storage area of the container through the capillary wick.

8. A writing instrument according to claim 1, further including a tubular member having a predetermined length extending into the first storage area from the writing side of the container, the tubular member sealing the capillary wick along the predetermined length of the tubular member.

9. A writing instrument according to claim 8, wherein the predetermined length of the tubular member extending into the first storage area from the writing side of the container determines a head pressure within the first storage area.

10. A writing instrument according to claim 8, wherein the tubular member is a film wrapped around the capillary wick.

11. A writing instrument according to claim 8, wherein the tubular member extends outwardly from the writing side of the container, and the proximal portion protrudes from the tubular member.

12. A writing instrument according to claim 1, further including a seal between the writing side of the container and the capillary wick to prevent liquid in the first storage area from leaking.

13. A writing instrument according to claim 1, wherein the distal portion of the capillary wick protrudes partially through the capillary storage.

14. A writing instrument according to claim 1, wherein the distal portion of the capillary wick protrudes through the capillary storage.

15. A writing instrument according to claim 1, further including a tip associated with the proximal portion of the capillary wick.

16. A writing instrument according to claim 1, wherein the capillary wick substantially fills the opening in the divider wall.

17. A writing instrument according to claim 1, wherein the approximate largest wick pore size has a predetermined diameter that is restricted so that a predetermined underpressure within the first storage area is substantially maintained as the liquid within the first storage area is transferred out of the first storage area through capillarity action of the capillary wick.

18. A writing instrument, comprising:

a container divided into a first storage area for storing liquid and a second storage area;

a tip;

a capillary storage in the second storage area and having an average storage capillarity;

a capillary wick within the first storage area and extending between the tip and the capillary storage, wherein the capillary wick has a longitudinal axis and at least a portion of the capillary wick within the first storage area along the longitudinal axis is in direct contact with the liquid in the first storage area; and wherein the capillary storage only comes into contact with liquid in the first storage area by way of the capillary wick, and the average wick capillarity being greater than the average storage capillarity, wherein the capillary storage has an uppermost storage capillarity, and the capillary wick has a lowermost wick capillarity and an uppermost wick capillarity, wherein the uppermost storage capillarity is between the lowermost wick capillarity and the uppermost wick capillarity.

19. A writing instrument according to claim 18, further including a tube sealing at least a portion of the capillary wick within the first storage area to minimize a head pressure.

20. A writing instrument according to claim 18, wherein the capillary wick extends into the second storage area, wherein the second storage area has a hole to provide an air passage to the capillary wick in the second storage area.

21. A writing instrument according to claim 18, wherein the capillary wick comprises first capillaries adapted to transport air and second capillaries adapted to transport liquid.

22. A writing instrument according to claim 18, wherein the second storage area is separated from the first storage area so that the capillary storage only comes into contact with liquid in the first storage area by way of the capillary wick.

23. A writing instrument, comprising:

means for storing liquid;

means for conveying the liquid from the means for storing liquid onto a writing surface;

means for storing excess liquid conveying from the means for storing liquid;

means for compensating for a rise in underpressure in the means for storing liquid due to liquid leaving the means for storing liquid; and means for separating the means for storing liquid from the means for storing excess liquid, wherein the means for storing excess liquid is above the means for storing liquid in a writing position.

24. A writing instrument according to claim 23, further including means for minimizing a head pressure in the means for storing liquid.

25. A writing instrument according to claim 23, wherein the means for conveying is a capillary wick having an approximate mean wick flow pore size, and the means for storing excess liquid has an approximate mean storage pore size, wherein the approximate mean wick flow pore size of the capillary wick is smaller than the approximate mean storage pore size of the capillary storage.

26. A writing instrument, comprising:

a container having a writing side and a rear side;

a porous divider wall between the writing and rear sides defining a first storage area for storing liquid and a second storage area, the porous divider wall having a measurable largest divider pore size and a measurable mean flow divider pore size;

a capillary storage within the second storage area and in contact with the porous divider, the capillary storage having a measurable mean flow storage pore size; and a tip partially within the first storage area and protruding from the writing side, the tip having a measurable largest tip pore size that is smaller than the measurable largest divider pore size, and the measurable mean flow divider pore size being smaller than the measurable mean flow storage pore size.

27. A writing instrument according to claim 26, further including:

a sleeve recessed into the first storage area and sealing the tip from the liquid in the first storage area.

28. A writing instrument according to claim 26, wherein the rear side of the container has a hole.

29. A writing instrument according to claim 28, wherein the capillary storage is adjacent to the hole.

30. A writing instrument according to claim 26, wherein the measurable largest pore size in the porous divider wall allows air to enter the first storage area to compensate for the liquid taken from the first storage area of the container through the tip.

31. A writing instrument, comprising:

a tip;

a container having a first storage area for storing liquid and a second storage area; and a capillary storage within the second storage area, wherein the first storage area is between the tip and the second storage area; and a capillary wick within the first storage area and extending between the tip and the capillary storage, wherein the capillary storage has an uppermost storage capillarity, and the capillary wick has a lowermost wick capillarity and an uppermost wick capillarity, wherein the uppermost storage capillarity is between the lowermost wick capillarity and the uppermost wick capillarity.

32. A writing instrument according to claim 31, further including a tube sealing at least a portion of the capillary wick within the first storage area to minimize a head pressure.

33. A writing instrument according to claim 31, wherein the second storage area has a hole to provide an air passage to the capillary wick in the second storage area.

34. A writing instrument according to claim 31, wherein the capillary wick includes first capillaries adapted to transport air and second capillaries adapted to transport liquid.

35. A writing instrument according to claim 31, wherein the second storage area is separated from the first storage area so that the capillary storage only comes into contact with liquid in the first storage area by way of the capillary wick.

36. A writing instrument, comprising:

a tip;

a container having a first storage area for storing liquid and a second storage area for storing a capillary storage, where the tip protrudes from the container and the first storage area is between the tip and the second storage area;

a capillary wick within the first storage area and extending between the tip and the second storage area, wherein the capillary wick includes first capillaries adapted to transport air and second capillaries adapted to transport liquid.

37. A writing instrument according to claim 36, further including a tube sealing at least a portion of the capillary wick within the first storage area to minimize a head pressure.

38. A writing instrument according to claim 36, wherein the second storage area has a hole to provide an air passage to the capillary wick in the second storage area.

39. A writing instrument according to claim 36, wherein the second storage area is separated from the first storage area so that the capillary storage only comes into contact with liquid in the first storage area by way of the capillary wick.

* * * * *